US006896570B1

(12) United States Patent
O'Keefe et al.

(10) Patent No.: US 6,896,570 B1
(45) Date of Patent: May 24, 2005

(54) FIN FOR A WATERSPORT BOARD

(76) Inventors: Thomas L. O'Keefe, 134 Calle de Los Molinos, San Clemente, CA (US) 92672; Dennis L. Daum, 134 Calle de Los Molinos, San Clemente, CA (US) 92672

( * ) Notice: Subject to any disclaimer, the term of this patent is extended or adjusted under 35 U.S.C. 154(b) by 0 days.

(21) Appl. No.: 10/792,967

(22) Filed: Mar. 4, 2004

(51) Int. Cl.[7] ..... B63B 35/79
(52) U.S. Cl. ..... 441/79
(58) Field of Search ..... 441/74, 79; 114/140

(56) References Cited

U.S. PATENT DOCUMENTS

| | | | | |
|---|---|---|---|---|
| 3,422,471 A | | 1/1969 | Morey et al. | 9/310 |
| 3,516,099 A | | 6/1970 | Morey et al. | 9/310 |
| 3,579,681 A | | 5/1971 | Pope, III et al. | 9/310 |
| 4,325,154 A | | 4/1982 | Collum, Jr. | 441/74 |
| 5,273,472 A | | 12/1993 | Skedeleski et al. | 441/79 |
| 5,306,188 A | | 4/1994 | Skedeleski et al. | 441/79 |
| 5,480,331 A | * | 1/1996 | Lewis | 441/79 |
| 5,649,846 A | | 7/1997 | Harper et al. | 441/79 |
| 5,951,347 A | | 9/1999 | Hudson et al. | 441/79 |
| 5,997,376 A | | 12/1999 | Block et al. | 441/79 |
| 6,139,383 A | | 10/2000 | Jolly et al. | 441/74 |

* cited by examiner

*Primary Examiner*—Ed Swinehart
(74) *Attorney, Agent, or Firm*—Stout, Uxa, Buyan & Mullins, LLP; Greg S. Hollrigel

(57) ABSTRACT

A fin for a watersport board, such as a surfboard, includes a substantially rigid core covered by a flexible core covering. The core may include one or more positioning members located on either side surface of the core. The core covering may be formed over the core without covering the positioning members. The fin may include a board coupling assembly that includes a plurality of plugs that each have a lumen lined with material of the flexible core covering. The board coupling assembly may secure the fin to the board by compression forces between a screw and the lining of the plug lumens. Methods of making and using such a fin are also disclosed.

18 Claims, 2 Drawing Sheets

FIN FOR A WATERSPORT BOARD

FIELD OF THE INVENTION

The present invention relates generally to fins for watersport boards. More particularly, the invention relates to flexible fins for surfboards and the like that have a substantially rigid core.

BACKGROUND

Fins are provided on watersport boards, such as surfboards, boogey boards, sailboards, and the like, to help control the boards while moving across water. Many conventional surfboards include a foam core coated with fiberglass and resin to form a hard surface. These types of surfboards may be referred to as "hardtop" surfboards. Both permanent and removable fins may be used with hardtop surfboards. Typically, such fins are substantially rigid and may be formed from fiberglass materials or injection molded plastics, such as nylon and the like. One example of removable fins is disclosed in U.S. Pat. No. 5,997,376.

Some conventional surfboards may be made from foam, but do not include a fiberglass and resin coating, at least on the top surface of the board. Instead, these types of surfboards have an upper surface made of a relatively soft foam material, and are therefore referred to as "softshell" surfboards. Softshell surfboards are typically provided with fins that are made of a relatively flexible material, such as a urethane (e.g. a polyurethane). The fins of softshell surfboards are typically much more flexible than fins of hardtop surfboards. Since the softshell surfboard fins are made from a flexible material, such fins are typically smaller and thicker than fins of conventional hardtop surfboards. The smaller profile and thickness of the fins provide reduced performance than the fins associated with hardtop surfboards.

Some hardboard fins are provided with a flexible coating along the leading and trailing edges of the fins, such as disclosed in U.S. Pat. Nos. 5,273,472 and 5,951,347. The flexible coating of these fins do not extend significantly to the side surfaces of the fins. The flexible coating is provided to help reduce injury resulting from contact with the fins.

SUMMARY

The present invention describes a fin for a watersport board. The fin includes a substantially rigid core and a core covering or shell having an increased flexibility relative to the core. The fin may be used on surfboards, including softshell and hardtop surfboards, boogey boards, sailboards, and the like.

In one embodiment, the fin comprises or includes a substantially rigid core and a flexible core covering. The substantially rigid core has a first side surface, a second side surface, and a peripheral edge located around the first and second side surfaces. The core includes at least one positioning member located on the first side surface, and at least one positioning member on the second side surface. The positioning members are effective to retain the core in a substantially fixed position while the fin is being manufactured, such as by injection molding. The positioning members are effective in reducing and or eliminating lateral movement of the core during the manufacture of the fin (e.g., movement that is substantially perpendicular or non-parallel to the first or second side surface). In addition, the at least two positioning members may be effective in reducing forward or backward movement of the core during the manufacture of the fin. The positioning members may also include identifying markings, such as logos or other designs. The core covering has an increased flexibility relative to the core, thereby providing a flexible or compressible outer fin layer. The core covering is fixedly secured (e.g., the core covering is not easily removed) over a major portion of the core. More specifically, the core covering is secured over a substantial portion of the first and second side surfaces, and in some embodiments, without covering the at least two positioning members.

In another embodiment, a fin for a watersport board, comprises a body portion and a base portion located at one end of the body portion. The body portion includes a substantially rigid core and a core covering formed of a flexible material. The base portion includes a plurality of plugs that are oriented and sized to be inserted into a body of a watersport board. Each plug has a lumen or hole extending therethrough, and the lumen is lined with the flexible material of the core covering. In a further embodiment, the base portion, including the plugs, is integrally formed with the substantially rigid core, or stated differently, the fin includes a foil body portion having an endoskeleton located in the foil body and an exoskeleton integrally formed with the endoskeleton and effective to couple the fin to a watersport board.

In yet another embodiment, a fin for a watersport board comprises a substantially rigid core and a flexible core covering fixedly secured to the core. The core has a board contacting surface, a first side surface with a plurality of positioning members extending therefrom, a second side surface with a plurality of positioning members extending therefrom, and a peripheral edge extending from the board contacting surface around the first and second side surfaces. The board contacting surface includes a plurality of plugs extending therefrom, each plug has a lumen substantially perpendicularly oriented to the board contacting surface. The flexible core covering is secured to the core without covering the plurality of positioning members. The flexible core covering also includes a portion extending into each of the lumens of the plurality of plugs to form an engagement surface with a screw or similar device utilized to secure the fin to a watersport board.

Any feature or combination of features described herein are included within the scope of the present invention provided that the features included in any such combination are not mutually inconsistent as will be apparent from the context, this specification, and the knowledge of one of ordinary skill in the art. In addition, any feature or combination of features may be specifically excluded from any embodiment of the present invention. Additional advantages and aspects of the present invention are apparent in the following detailed description and claims.

DETAILED DESCRIPTION

Figure 1:
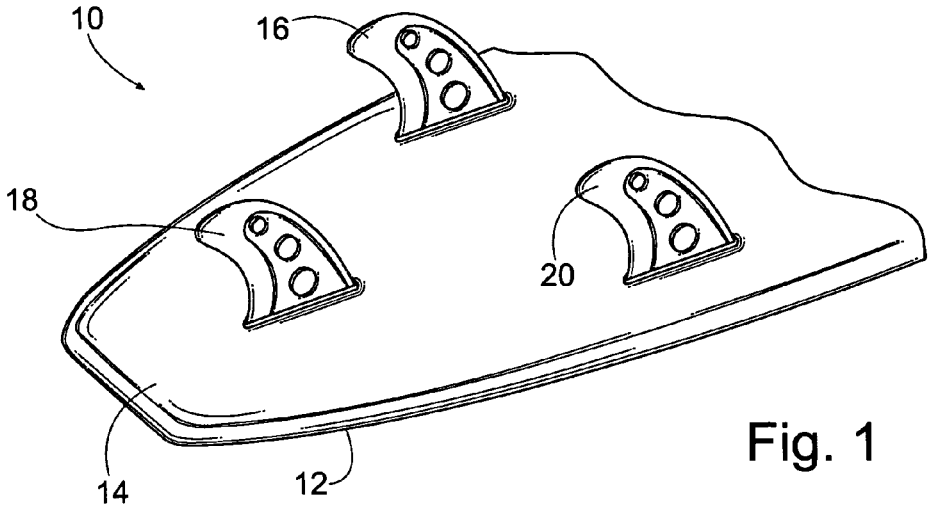
FIG. 1 is a perspective view of a tail of a surfboard having three fins.

A fin for a watersport board, such as a surfboard and the like, in accordance with the disclosure herein, includes a flexible outer covering or shell surrounding a substantially rigid core. The fin disclosed herein typically has a size, such as a height, greater than fins of conventional softshell surfboards and is more flexible than fins of conventional hardtop surfboards. The outer covering is secured to the rigid core to create a unitary fin assembly that can be attached to a board.

Reference will now be made in detail to the presently preferred embodiments of the invention, examples of which are illustrated in the accompanying drawings. Wherever possible, the same or similar reference numbers are used in the drawings and the description to refer to the same or like parts. It should be noted that the drawings are in simplified form and are not to precise scale. In reference to the disclosure herein, for purposes of convenience and clarity only, directional terms, such as, top, bottom, left, right, up, down, over, above, below, beneath, rear, front, backward and forward, are used with respect to the accompanying drawings. Such directional terms should not be construed to limit the scope of the invention in any manner.

Although the disclosure herein refers to certain illustrated embodiments, it is to be understood that these embodiments are presented by way of example and not by way of limitation. The intent of the following detailed description, although discussing exemplary embodiments, is to be construed to cover all modifications, alternatives, and equivalents of the embodiments as may fall within the spirit and scope of the invention as defined by the appended claims.

As shown in FIG. 1, a surfboard 10 includes a top surface 12, a bottom surface 14, and three fins 16, 18, and 20 extending from the bottom surface 14. The surfboard 10 may be any conventional surfboard, including hardtop and softshell surfboards. In the illustrated embodiment, and in reference to the following disclosure, the surfboard 10 is a softshell surfboard, as is understood by persons of ordinary skill in the art. Fins 16 and 20 are located on opposite sides of fin 18. Typically, the inner side surface of each of fins 16 and 20 are planar, and the outer side surfaces are foiled. In comparison, both side surfaces of fin 18 are typically foiled.

For purposes of convenience, fin 18 will be used as an example of a fin in accordance with the disclosure herein. However, it will be understood that the following description with respect to fin 18 will similarly apply to other fins of a board, such as fins 16 and 20.

Figure 2:
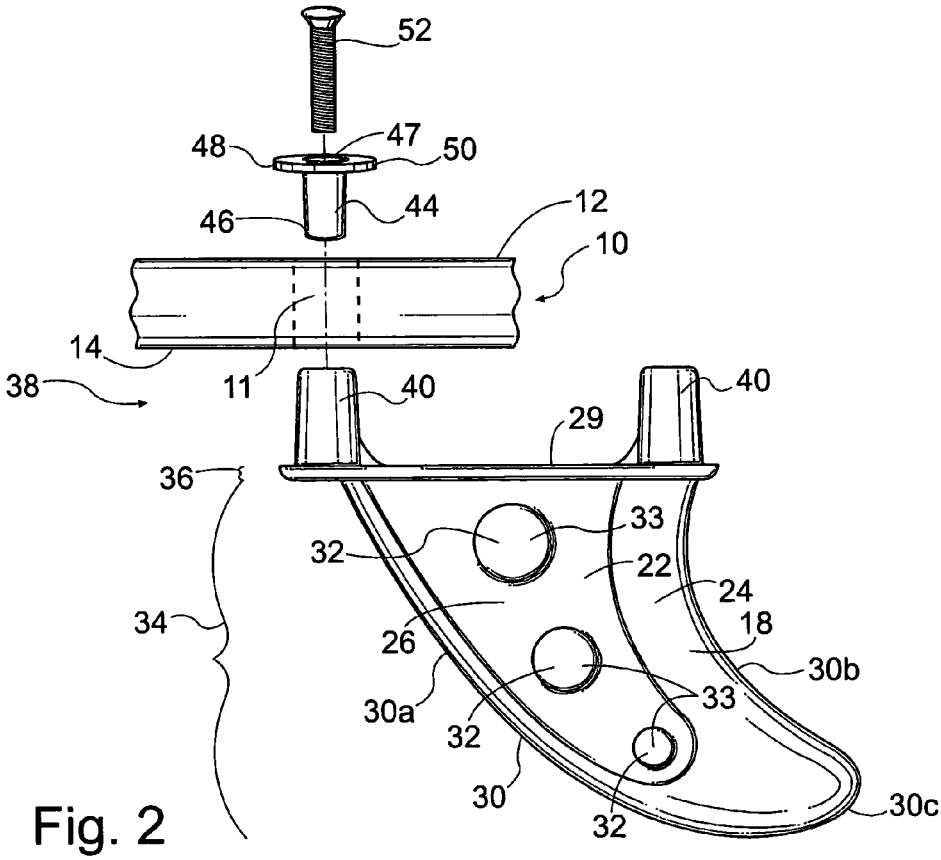
FIG. 2 is an exploded view of a fin in accordance with the disclosure herein being coupled to a surfboard.
Figure 3:
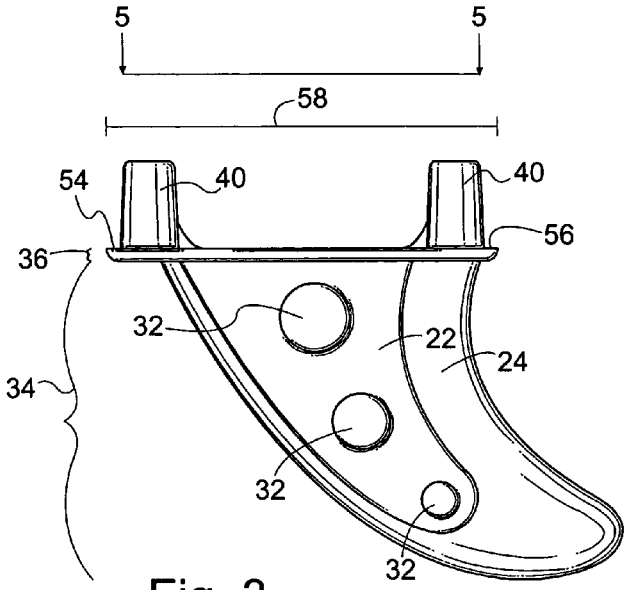
FIG. 3 is a side plan view of the fin of FIG. 2.
Figure 4:
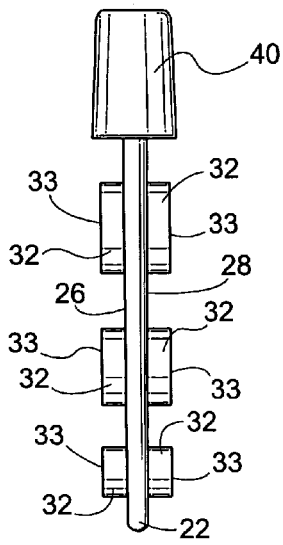
FIG. 4 is a rear plan view of a core of the fin of FIG. 3.

As shown in FIGS. 2–4, fin 18 includes a substantially rigid core 22 and a core covering or shell 24 located over a major portion of the core 22. The core 22 includes a first side surface 26, a second side surface 28, a board contacting surface 29, and a peripheral edge 30. The peripheral edge 30 is located around the first side surface 26 and the second side surface 28. The core 22 is generally provided in the shape of a fin, such as a surfboard fin. For example, the peripheral edge can be understood to include a leading edge portion 30*a*, a trailing edge portion 30*b*, and a tip portion 30*c* including the intersection of the leading edge portion 30*a* and the trailing edge portion 30*b*. Typically, and as illustrated, the peripheral edge 30 is devoid of a major linear or straight segment. In addition, the core 22 is substantially solid. In certain embodiments, the core 22 is devoid of through holes in the side surfaces 26 and 28 or along the peripheral edge 30, such as those disclosed in U.S. Pat. No. 5,951,347. In some embodiments, the core 22 is solid or is not hollow. The core 22 may be made from any suitable rigid or semi-rigid material, such as plastics and the like that can be used in injection molding procedures. For example, the core may comprise a nylon material, and in the illustrated embodiment, the core 22 is formed from glass fiber-filled nylon material, such as a nylon material that is fifty percent filled with glass fibers. In addition, and in the illustrated embodiment, the core 22 is a unitary member (e.g., it does not include two or more separate elements joined together). The core 22 may be understood to be an endoskeleton of the core covering 24, or in reference to fin 18, an endoskeleton to a foiled fin body.

The core 22 includes a plurality of positioning members 32 located on both the first side surface 26 and the second side surface 28. More specifically, the first side surface 26 includes three positioning members 32 and the second side surface 28 includes three positioning members 32. However, in other embodiments, more or fewer positioning members may be provided. For example, certain embodiments may have one positioning member on each of the side surfaces. Thus, the core 22 includes at least two positioning members 32. In the illustrated embodiment, the positioning members 32 are symmetrically located on each of the side surfaces 26 and 28, that is the positioning members are located opposite each other. The positioning members 32 are provided to retain the core in a substantially fixed position while the fin is being manufactured. For example, the fin 18 may be manufactured using conventional injection molding procedures, as discussed herein. The positioning members 32 are effective to reduce, and preferably prevent, lateral movement of the core 22 during manufacture of the fin. As discussed herein, the positioning members 32 may be clamped or held together by pressure substantially normal to the positioning members. Since the positioning members are typically located at equal positions on opposite sides of the core, lateral movement is effectively reduced.

As shown in FIG. 4, the positioning members 32 are shown to extend from the side surfaces 26 and 28 of the core 22. Thus, the positioning members 32 may be understood to be protrusions extending from a side surface of the core 22. The positioning members 32 include an engagement surface 33 spaced apart from and oriented substantially parallel to the side surfaces of the core 22. The positioning members 32 are illustrated as being substantially circular in shape when viewed orthogonally to the first side surface 26 or the second side surface 28. Other surface or cross-sectional configurations may also be provided for the positioning members. For example, the engagement surface 33 may include one or more structural modifications so that the surface is uneven. Such modifications include logos and other designs that may be desired for fins. These structural modifications, including logos, may be effective in reducing, or preventing, forward or backward movement of the core during a manufacturing process of the fin. Such forward or backward movement may be rotational movement of the core about an axis that is substantially perpendicular to the engagement surface 33, or it may be linear movement of the core. In addition, or alternatively, the cross-sectional configuration may include an engagement portion that is effective to reduce the forward or backward movement of the core. For example, the cross-section of the positioning member may include a straight edge.

The core covering 24 is illustrated as being located over a major portion of the core 22. More specifically, the core covering 24 is located over significant portions of the first and second side surfaces, 26 and 28, respectively. The core covering 24 does not substantially cover the positioning members 32. The core covering 24 has a thickness, and the thickness of the core covering 24 near the positioning members 32 is approximately equal to the distance the engagement surface 33 is spaced from a side surface of the core 22. Thus, the core covering 24 and engagement surface 33 define a substantially even surface topography.

The core covering 24 has an increased flexibility relative to the core 22. More specifically, the core covering 24 is made from a material that may be injection molded, and remains more flexible than the core 22. The core covering 24 may be made from plastic materials, such as urethane, and more specifically, polyurethane. The core covering 24 thus forms a majority of the shape of the fin 18, and more specifically, the core covering 24 also includes first and second side surfaces similar to the first and second side surfaces of the core 22. Thus, the core covering 24 may be understood to contribute to more of the fin structure than fins that have a flexible material covering located only around the peripheral edge.

The fin 18 illustrated in FIGS. 2 and 3 may also be understood to include a body portion 34 and a base portion 36. The body portion 34 includes the substantially rigid core 22 and the flexible core cover 24. The substantially rigid core 22 may be understood to be an endoskeleton for the flexible core cover 24. The base portion 36 is located at one end of the body portion 34, and in particular, at the end of the body portion 34 that is opposite the tip 30*c* of the fin. The base portion 36 includes a board coupling assembly generally shown at 38. The board coupling assembly 38 is configured to permit the fin 18 to be attached to a board, such as board 10 (shown in FIGS. 1 and 2). The board coupling assembly 38 may provide for permanent or temporary coupling of the fin 18 to the board 10.

In the illustrated embodiment, the board coupling assembly 38 includes a plurality of plugs 40. Each plug 40 is oriented and sized to be inserted into a body of a watersport board, such as surfboard 10. In the illustrated embodiment, each plug 40 extends from the board contact surface 29 of the core 22. More specifically, and as shown in FIG. 6, each of plug 40 is integrally formed with the core 22. Thus, the fin 18 may be understood to include a foiled body portion having a substantially rigid endoskeleton, and an integrally formed exoskeleton effective to couple the fin to a board. Each plug 40 has a lumen or hole 42 (see FIGS. 5 and 6) extending through the plug. The lumen 42 is lined with the flexible material of the core covering 24, as discussed herein.

The board coupling assembly 38 also includes a spacer member 44. The spacer member 44 has a first end 46, a second end 48 spaced apart from the first end 46, and a spacer member lumen 47 extending from the first end 46 to the second end 48. The second end 48 has a lip 50 that is configured to contact a top surface of a board, such as top surface 12 shown in FIG. 2. The board coupling assembly 38 also includes a screw 52, or other similar device, that is sized to be inserted through the spacer member lumen 47 and into the plug lumen 42. In one embodiment, the screw 52 may be a self-tapping mineral filled nylon screw having about 1-¼ inch flanges. In other embodiments, the self-tapping screw may be made of other materials. Tightening of the screw 52 is effective to compress the base portion 36 and the spacer member 44. The compression acts on the board 10 to couple the fin 18 in a fixed position on the board.

The base portion 36 is shown as including a first end 54, a second end 56, and a length 58 extending from the first end 54 to the second end 56. The plug lumens 42 are illustrated as being transversely oriented to the length 58 of the base portion 36.

Figure 5:
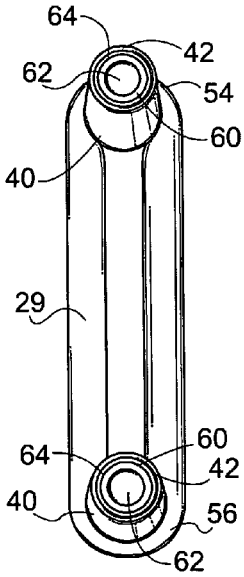
FIG. 5 is a top plan view along line 5—5 of FIG. 3.
Figure 6:
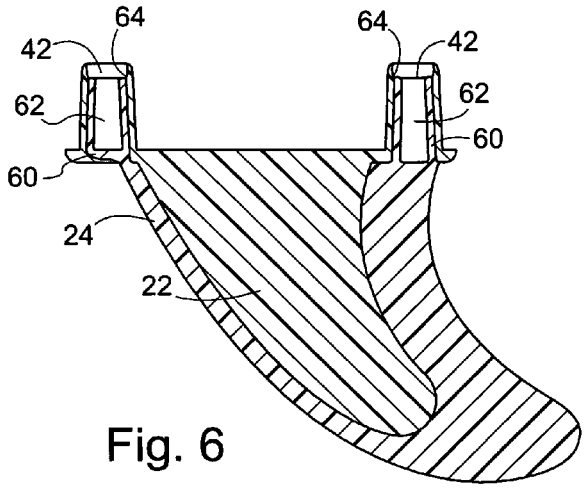
FIG. 6 is a sectional view of the fin of FIG. 3.

As shown in FIG. 5 and FIG. 6, each of the plugs 40 include a lumen 42 that is lined with the material of the core covering 24. The lining 60 in the lumen 42 forms a second lumen 62 that is sized to accommodate the screw 52 of the board coupling assembly 38. FIG. 6 illustrates that the lining 60 is integrally formed with the core covering 24. In the illustrated embodiment, the lining 60 is formed as the core covering 24 is injected into a mold around the fixed core 22. The lining 60 is typically devoid of threads during the manufacture of the fin. As the fin 18 is attached to a board, such as board 10, the screw 52 is threadedly advanced into the lining lumen 62. The threads on the screw 52 engage with the flexible material of the lining 60 to provide a desired engagement between the fin 18 and the board 10. In the illustrated embodiment, tightening of the screw 52 causes the lining 60 (and hence, the core covering 24) to be "pulled" into plug lumen 42, thereby providing a relatively strong connection between the fin 18 and the board 10. The lining 60 may become threaded after engagement with the screw 52.

As illustrated in FIGS. 5 and 6, the plugs 40 may also include a step 64 that is effective to reduce the forward or backward movement of the core 22 during the manufacture of the fin. The step 64 is shown as being located in the interior of the plug 40, and around the lumen 42. The step 64 provides an engagement or alignment surface that is used to facilitate alignment of the core in a mold, for example. The engagement surface may be substantially parallel to the top end of the plug 40, or it may include an angled surface. As discussed above, the step 64 may be effective to reduce or prevent either or both rotational or longitudinal movement of the core during the manufacture of the fin. The step 64 does not necessarily have to be continuous around the interior of the plug. For example, the step could be provided as multiple fragments with spaces between each fragment. In addition, the plugs 40 may include other positioning elements, instead of or in addition to, the steps that are effective to reduce rotational or longitudinal movement of the core, such as movement other than lateral movement.

As discussed herein, the fin 18 may be made by injection molding processes. In one embodiment, the core 22 is formed by delivering glass fiber-containing nylon into a core mold. The core mold includes a desired number of recesses or other similar structures to permit formation of the positioning members 32 on the core 22. The hardened core 22 is removed from the first mold and then positioned in a second mold having dimensions of a desired fin. The core 22 is held in position in the second mold by physical engagement with the positioning members 32 and the steps 64, described herein. In certain embodiments, the core 22 is held in position by compressive forces acting on the positioning members on either side of the core 22. These compressive forces may be applied by the second mold, or may be applied through one or more holes located in the second mold. A polyurethane composition is then delivered into the second mold, such as by way of an access port provided near the base portion 36 of the core 22. The polyurethane composition flows into the hollow portions of the mold around the core and into the plug lumens 42. Without a positioning member 32, as described herein, the core 22 typically laterally moves within the mold during the delivery of the polyurethane composition. Without a step 64, as described herein, the core 22 typically rotates or moves in the forward or backward direction. Thus, by providing a positioning member 32 on the core 22, the core 22 can be laterally retained in a fixed position while the polyurethane material is delivered into the mold. After the polyurethane composition has cured, the fin 18 may be removed from the second mold. The core covering 24 is secured around the core 22 as the covering hardens. In addition, the positioning members 32 may provide some retention capabilities to maintain the core covering 24 in a fixed position.

As shown in FIG. 2, the fin 18 may be attached to a board 10 by inserting the plugs 40 into a corresponding number of board cavities 11 that extend from the bottom surface 14 to the top surface 12 of the board 10. Spacer members 44 may then be inserted into the board cavities 11 that are located at the top surface 12 of the board 10. Screws 52 may then be inserted through the spacer members into the plugs of the fin. Tightening of the screws causes the spacer member and the base of the fin to compress the board to provide a fixed attachment to the board 10.

In one specific embodiment, a fin comprises a substantially rigid core formed from glass-fiber filled nylon and a flexible core covering formed from polyurethane. The base of the fin has a maximum length of about 5 inches, a maximum height from the base to the fin tip of about 4 inches, and a maximum thickness of about ⅜ to ½ of an inch. The core of the fin has a base with a maximum length of about 4-¾ inches, a maximum height from the base to the tip of the core of about 3-⅜ inches, and a maximum thickness of about ⅛ of an inch. The positioning members have a maximum diameter of about ¾ of an inch and include engagement surfaces that are spaced apart from a side surface of the core by about 1/16 of an inch. The plugs have a maximum height of about 1-¼ inches, a maximum outer diameter of about ¾ inch, and a maximum inner diameter of about ½ inch. The lumen of the lining in the plug has a maximum diameter of about 3/16 inch. The spacer member has a height of about 1 inch, an outer diameter at its first end of about ⅜ inch, and an outer diameter at its second end of about 1-¼ inches. The screw has a length of about 1-½ inches, and a diameter at the threaded portion of about ¼ inch.

While this invention has been described with respect to various specific examples and embodiments, it is to be understood that the invention is not limited thereto and that it can be variously practiced with the scope of the following claims. Multiple variations and modifications to the disclosed embodiments will occur, to the extent not mutually exclusive, to those skilled in the art upon consideration of the foregoing description.

For example, the fin of the present invention may include a board coupling assembly that does not use compressive forces to secure the fin to the board. In one embodiment, a fin may be coupled to a board using an adhesive composition, which may include compositions suitable for convention non-removable fins. In another embodiment, a fin may be coupled to a board by a pressure fit between a base of the fin and a fin box located in the board. In yet another embodiment, the fin may be coupled using a mechanical locking device, such as a screw, that may engage with the base of the fin and a fin box provided in the board.

In addition, or alternatively, the positioning members of the core may be provided as separate elements that are not necessarily co-molded with the core. For example, positioning members may be adhesively secured to one or more side surfaces of the core using an appropriate adhesive composition. Similarly, the core covering may be coupled to the core using an adhesive composition to increase the strength of coupling between the covering and the core. Or, the covering and core may be bonded together using other means which may permit a portion of the core covering to intermix with a portion of the core.

A number of patents have been identified herein. Each of these identified patents is hereby incorporated by reference in its entirety.

What is claimed is:

1. A fin for a watersport board, comprising:

a substantially rigid core having a first side surface, a second side surface, and a peripheral edge around the first and second side surface, the core including at least one positioning member located on the first side surface, and at least one positioning member located on the second side surface, the positioning member being effective to retain the core in a substantially fixed position while the fin is being manufactured;

a core covering having an increased flexibility relative to the core and being fixedly secured over a major portion of the core, including the first and second side surfaces; and a board coupling assembly structured to secure the fin to a watersport board, the board coupling assembly including a plurality of plugs sized to be inserted into the watersports board, each plug including a lumen lined with a portion of the core covering.

2. The fin of claim 1, wherein the core includes a plurality of positioning members located on each of the first and second side surfaces, the positioning members located on the first side surface being located directly opposite of the positioning members on the second side source.

3. The fin of claim 1, wherein each positioning member includes an engagement surface spaced away from the side surface from which the positioning member is located.

4. The fin of claim 1, wherein the core covering is located over the first and second side surfaces without substantially covering a positioning member.

5. The fin of claim 1, wherein the core comprises a semi rigid plastic material, and the core covering comprises a soft elastomeric plastic material.

6. The fin of claim 1, wherein the board coupling assembly further comprises (i) a spacer member having a first end, a second end sized to contact a top surface of the watersport board, and a lumen extending from the first end to the second end; and (ii) a screw sized to be inserted through the lumen of the spacer member and into the lumen of the plug.

7. The fin of claim 1 provided on a surfboard.

8. A fin for a watersport board, comprising:

a body portion including a substantially rigid core and a core covering formed of a flexible material; and a base portion located at one end of the body portion, the base portion including a plurality of plugs, each plug oriented and sized to be inserted into a body of a watersport board, and having a lumen extending through the plug, the lumen lined with the flexible material of the core covering.

9. The fin of claim 8, wherein the rigid core includes a first side surface, a second side surface, and at least one positioning member located on each of the first and second side surfaces.

10. The fin of claim 8, wherein the base portion includes a first end and a second end, and a length extending from the first end to the second end, the lumen of the plugs being transversely oriented to the base portion length.

11. The fin of claim 8, further comprising (i) a spacer member having a first end, a second end spaced apart from the first end and a spacer member lumen extending from the first end to the second end, the second end having a lip configured to contact a top surface of the watersport board; and (ii) a self-tapping screw sized to be inserted through the spacer member lumen into the plug lumen, wherein tightening of the screw compresses the base portion and the spacer member.

12. The fin of claim 8 provided on a surfboard.

13. The fin of claim 8, wherein the core comprises glass fiber-filled nylon and the core covering comprises polyurethane.

14. The fin of claim 8, wherein the plurality of plugs are integrally formed with the core of the body portion.

15. The fin of claim 8, wherein the plug lumens are lined with a portion of the core covering.

16. The fin of claim 8, further comprising an engagement surface located in a plug, the engagement surface being effective to reduce forward or backward movement of the core during manufacture of the fin.

17. The fin of claim 8, wherein the core includes a first side surface and a second side surface, and the core covering is provided over a substantial portion of the first and second side surface.

18. A fin for a watersport board, comprising:

a substantially rigid core having a board contacting surface, a first side surface with a plurality of positioning members extending therefrom, a second side surface with a plurality of positioning members extending therefrom, and a peripheral edge extending from the board contacting surface around the first and second side surfaces, the board contacting surface including a plurality of plugs, each plug having a lumen substantially perpendicularly oriented to the board contacting surface; and a flexible core covering fixedly secured to the core without substantially covering the plurality of positioning members, and including a portion extending into each of the lumens of the plurality of plugs to form an engagement surface with a screw utilized to secure the fin to a watersport board.

* * * * *